United States Patent [19]

Held et al.

[11] 4,357,809

[45] Nov. 9, 1982

[54] COOLING ARRANGEMENT INCLUDING A GEL

[75] Inventors: Edward J. Held, Canoga Park; Daniel Broder, Westlake Village, both of Calif.

[73] Assignee: THAT Distributing Company, Inc., Reseda, Calif.

[21] Appl. No.: 202,465

[22] Filed: Oct. 31, 1980

[51] Int. Cl.[3] ..... F25D 3/08

[52] U.S. Cl. ..... 62/457; 215/13 R; 220/426; 220/902

[58] Field of Search ..... 215/13 R; 220/428, 426, 220/902; 62/457, 371, 530, 430

[56] References Cited

U.S. PATENT DOCUMENTS

| | | | |
|---|---|---|---|
| 3,161,031 | 12/1964 | Flannery | 62/457 |
| 3,205,678 | 9/1965 | Stoner | 62/457 |
| 3,302,427 | 2/1967 | Stoner et al. | 62/457 |
| 3,302,428 | 2/1967 | Stoner et al. | 62/457 |
| 3,360,957 | 1/1968 | Paquin | 62/457 |
| 3,394,562 | 7/1968 | Coleman | 62/457 |
| 3,603,106 | 9/1971 | Ryan | 62/457 |
| 3,715,895 | 2/1973 | Devlin | 62/457 |
| 3,766,975 | 10/1973 | Todd | 62/457 X |
| 3,922,879 | 12/1975 | Arnold | 62/457 X |
| 4,183,226 | 1/1980 | Moore | 62/457 |

*Primary Examiner*—Lloyd L. King

*Attorney, Agent, or Firm*—Christie, Parker & Hale

[57] ABSTRACT

A beverage cooling arrangement having an inner receptacle defined by a closed end, an open end and a wall disposed between the open and closed ends. An outer encasement partially encases the inner receptacle, and the encasement is joined at the upper end to the inner receptacle along the open end thereof forming a cavity between the inner receptacle and the encasement. A layer of cellular compressible heat-insulating material is disposed within the cavity adjacent the encasement. A solid gel refrigerant is disposed within the remainder of the cavity between the insulation layer and the receptacle. A base is secured to the outer encasement so as to completely seal and isolate the cavity from the outside environment.

9 Claims, 5 Drawing Figures

COOLING ARRANGEMENT INCLUDING A GEL

BACKGROUND OF THE INVENTION

This invention relates generally to holders for maintaining beverages in a chilled state, and particularly concerns an arrangement for cooling the beverages either poured into the holder or held in containers placed in the holder.

It is often desirable to consume beverages such as alcoholic beverages and soft drinks when such drinks are in a chilled condition. Typically, these beverages are stored in a cooled area such as a refrigerator or ice chest in order to lower the temperature to that appropriate for consumption.

Normally it is desirable when consuming such beverages to maintain the beverage at a suitable chilled temperature.

Conventional rates of consumption of such beverages are usually at a relatively slow rate such that the beverages remain exposed to normal room temperatures for sustained periods of time. Consequently, the temperature of the beverage rises towards room temperature with a corresponding loss of desirability for the beverage. Several inappropriate alternatives are available in order to consume the beverage while it is at the desired chilled temperature. One may, for example, consume the beverage rapidly or return the beverage to a refrigerated area during the periods between consumption.

Another aspect of the increase of the beverage temperature arises from the handling of the beverage containers. Thus, for example, soft drink and beer cans usually require manual handling with a resulting increase in temperature of the cans and their contents. In addition to the temperature rise of the beverage in the cans, condensation developing on the exterior surface of the container is transferred to the person handling it. Thus, a corresponding nuisance due to the condensation being transferred to the hand of the user occurs.

Several prior-art devices are available which attempt to remedy the aforementioned problems. One such device comprises a foam-molded cup that conforms to the shape of conventional beverage and beer cans. Typically, a closed cell foam material that partially encircles the can is used in an attempt to reduce the rate at which the temperature of the beverage rises. Although such foam can holders reduce the heat absorption of the beverage, they are relatively ineffective over extended periods of time thereby limiting their utility. Another factor adding to the temperature rise of the beverage is the fact that conventional beverage container material is usually formed of aluminum or glass. These materials have a relatively high rate of thermal conductivity which even enhances the rate of heat absorption from the environment into the beverage.

Another attempt to provide beverage holders for maintaining a constant chilled beverage temperature is disclosed by Joseph Canosa in U.S. Pat. No. 3,680,330. Canosa describes a double-walled vessel that includes a sealed chamber containing a refrigerant which partially encloses a beverage compartment. The vessel includes an annular channel about the vessel base for catching condensation drippings and directing them to a storage chamber beneath the drinking compartment. The vessel employs in its refrigerating chamber a refrigerant which changes state upon being stored for an appreciable period in the freezing compartment of an ordinary refrigerator. The refrigerant is a fluorinated chlorinated hydrocarbon that changes state from a liquid to vapor at a temperature of between 20° and 40° F. The refrigerant is intended to maintain the beverage at a suitable temperature.

This type of structure suffers from several important disadvantages. The refrigerant is a liquid at room temperature becoming a solid after exposure to chilled temperatures (i.e., 30° to 40° F.) typically found in refrigerators and ice chests. Usually the vessels are formed of plastic. At room temperature, the cracking or fracturing of the refrigerant containing compartment as a result, for example, of dropping the vessel on a hard surface, causes the refrigerant to empty from the vessel. At such time the utility of the vessel in terms of a container for chilled beverages substantially ceases. Materials may be employed having fracture-resistant qualities, however, such materials provide excessive weight to the vessel as well as cost.

Furthermore, the device described by Canosa includes only a single chill-maintaining element in the coolant-containing chamber. Thus, Canosa must rely solely on the refrigerating ability of the refrigerant to maintain the beverage at the desired temperature. Such a single-element arrangement suffers from the inability to maintain the beverage held by the vessel at the desired temperature over a sustained period of time.

Another such device is disclosed by Moore in U.S. Pat. No. 4,183,226. Moore describes a refrigerated beverage holder for canned and bottled beverages. The holder comprises a hollow-walled container having a refrigerant disposed within the container's hollow walls. Another aspect of the Moore invention includes the refrigerant disposed within the side walls of a relatively thin wall bag. The bag circumscribes the interior of the holder and conforms to the outer contour of a beverage can placed in the holder. The refrigerant disclosed by Moore is water which is known to have a relatively rapid freeze/thaw cycle. Thus, this type of refrigerant is not capable of maintaining beverages contained in the holder at a desired low temperature for long periods of time (i.e., one to three hours). The disadvantages of such an arrangement are consistent with the prior art previously discussed.

The problems and deficiencies of the prior art are overcome by the present invention.

SUMMARY OF THE INVENTION

Briefly, this invention comprises a beverage cooling arrangement having an inner receptacle for receiving a beverage and an outer encasement partially encasing the inner receptacle. The receptacle has closed and opened ends and a wall between the open and closed ends. The encasement has an upper and lower end. The upper end of the encasement is joined to the receptacle along the open end thereof and forming thereby a cavity between the receptacle and the encasement.

As a feature of the invention, a layer of cellular, compressible heat-insulating material is disposed within the cavity adjacent the encasement wall. Preferably, the insulating material comprises closed-cell styrene formed of cross-linked polyethelyene.

A solid gel refrigerant is disposed within the cavity between the insulation layer and the receptacle. Preferably, the gel has a freezing temperature of about 30° F. Preferably, the refrigerant consists of about 15% by weight of cornstarch, borax in the amount of about 2% by weight of the cornstarch, about 0.01% by weight of non-toxic preservative and about 84.7% by weight of water.

The invention described herein provides advantages not available with the prior-art devices. The refrigerant gel is solid and thus will not leak out of the holder in the event that the holder sustains damage sufficient to expose the gel. The unique and novel combination of the gel and the insulating material disposed within the cavity provides a holder capable of maintaining a beverage at a temperature of about 40° F. for periods extending for about four to five hours.

Additionally, the solid gel never melts, does not evaporate and is self-sealing against punctures and ruptures occurring in regions of the holder adjacent the gel. The layer of insulation between the gel and the encasement provides an insulating barrier between the gel and the encasement to inhibit absorption of heat by the gel through the encasement. Advantageously, condensation on the encasement is correspondingly reduced.

DETAILED DESCRIPTION

Figure 1:
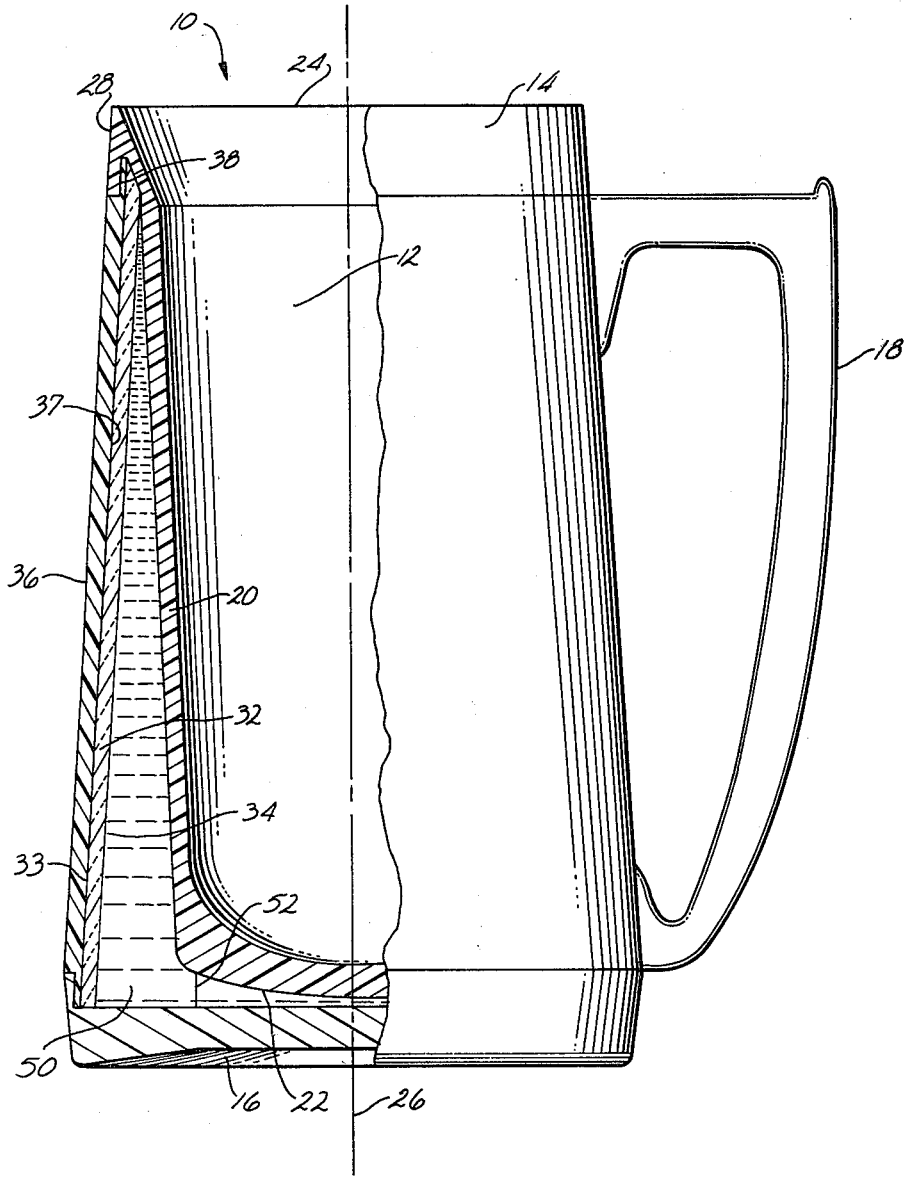
FIG. 1 is a view in elevation and partly in cross section of a first embodiment of a holder embodying the principles of the invention.

Referring first to FIG. 1, there is shown in partial side elevation view, the beverage holder 10 having an inner receptacle 12, an outer encasement 14, a base or support 16 and a handle 18.

Figure 2A:
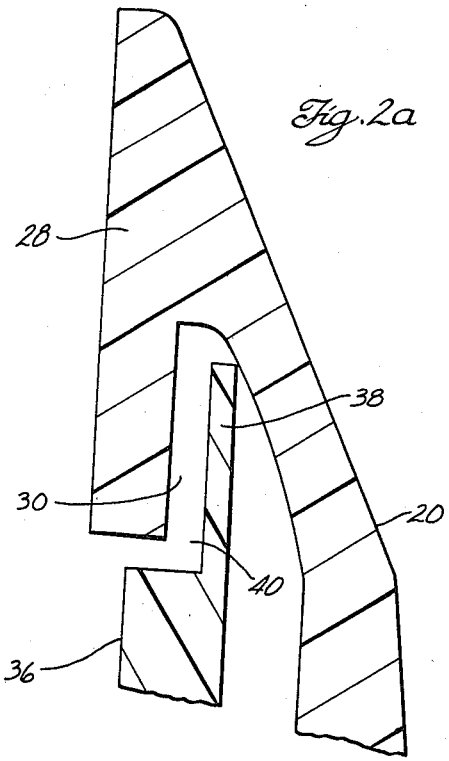
FIGS. 2*a* and 2*b* are partial exploded views of the encasement, receptacle and base grooves of the holder of FIG. 1.

The inner receptacle 12 has a side wall 20 that extends essentially vertically from a bottom wall 22 to the open end of the receptacle 24. The side wall 20 is annular about the holder axis 26 and the bottom wall 22 forms the closed end of the receptacle 12. An annular depending flange 28 extends downward from the receptacle open end 24. The flange 28 has an annular interior groove 30. As more clearly shown in FIG. 2*a*, the groove 30 has a generally rectangular cross section.

Preferably, the receptacle 12 is formed by any of a number of molding techniques such as injection molding. The receptacle 12 may be formed of a unitary piece of fracture-resistant and insulating plastic such as polyvinyl chloride conventionally known as PVC.

Figure 2B:
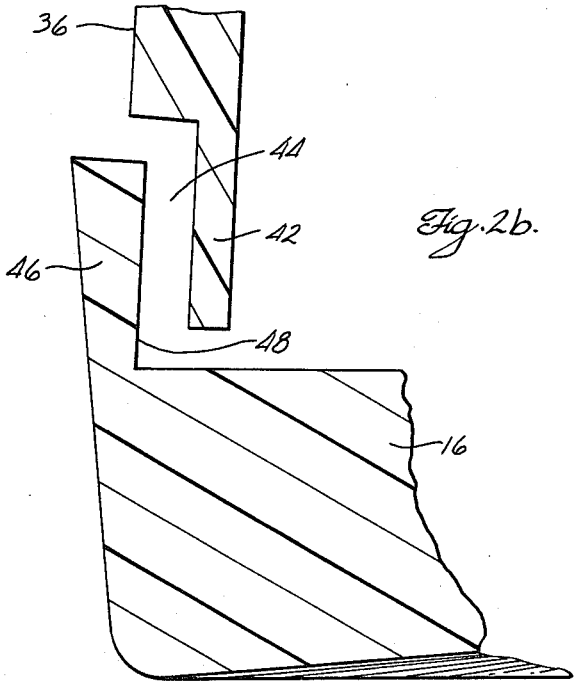

The encasement 14 has an annular wall 36 that flares outward at about an angle of 10° with respect to the axis 26 of the holder. The upper extremity 38 of the annular wall 36 has an exterior annular recess 40 (more clearly shown in FIG. 2*a*) having a cross section complementary with that of the side wall groove 30. The lower extremity 42 of annular wall 36 has an exterior annular recess 44. The recess 44 has a rectangular cross section (better shown in FIG. 2*b*). The encasement 14 is joined to the receptacle 12 at the juncture of groove 30 and 40. In securing the receptacle 12 to the encasement 14, any one of a number of conventional adhesives or welding techniques may be used. The handle 18 is secured to the encasement 14 for enabling handling of the holder 10 in a conventional manner.

An annular support base 16 forms the bottom of the holder 10. The support base 16 has an upstanding annular flange 46 that has an interior wall 48 having a cross section complementary with that of the recess 44.

The support base 16 is joined to the annular wall 36 at the juncture of recess 44 and wall 48. As previously discussed, any one of a number of adhesives or welding techniques may be used.

The joining of the support base 16 to the annular wall 36 forms an annular cavity 50 within the boundaries defined by the encasement 14, receptacle side wall 20 and the support base 16. A space 52 between the bottom wall 22 and the support base 16 is provided so as to maintain the bottom wall 22 out of contact with the support base 16.

The cavity 50 includes a layer of insulation material 32 disposed adjacent encasement interior surface 37. The insulation preferably is formed of closed-cell, chain-linked styrene. The insulation faces 33 and 34 are essentially parallel to each other, and the thickness of the sheet, as measured between and normal to the faces, is preferably about ⅛ inch.

The remainder of cavity 50, i.e., the region defined between the insulation 32, receptacle wall 20 and support base 16, is filled with a solid refrigerant gel. Preferably, the freezing point of the gel is about 30° F. and when frozen at such temperature will maintain prechilled beverages placed within the inner receptacle at between 30° and 40° F. for a period of time of about four to five hours. Preferably, the solid refrigerant gel consists of about 15% by weight of cornstarch, borax in the amount by weight of 2% of the cornstarch, about 0.01% by weight of non-toxic preservative and about 84.7% by weight of water. Preferably, the cornstarch is cold water soluble and requires no cooking or other preparation techniques. Such starches are available from the Staley Manufacturing Company under the Trademark HAMACO. The non-toxic preservative may be one of a number of known preservatives such as potassium sorbate. The insulation and refrigerant gel are inserted into the cavity 50 prior to joining the support base 16. The refrigerant gel may be inserted into the cavity 50 by a number of known injection techniques.

The refrigerant gel consisting of the foregoing described ingredients is characterized in that it is a non-melting non-evaporating solid material. The gel is self-sealing against fractures and rupture such that if the holder experiences such fracture along material surfaces in contact with the gel, the gel will form a hardened seal along the rupture, thus maintaining the holder in a relatively unaffected condition. The hardening of the gel along the rupture is a result of the contact of air with the gel in the area surrounding the fracture.

Although the discussion to this point involves the use of the gel as a refrigerant, it is noted that the holder may also be used for maintaining beverages within the holder at some desirable elevated temperature. Thus, for example, if the holder was used for maintaining beverages, such as hot coffee, at a desired consumption temperature, the holder would not be exposed to prior freezing temperatures, but rather, used when the gel is initially at room temperature. For such uses, the gel is capable of maintaining a beverage in the holder at temperature of about 150° to 160° for about one and one-half hours.

The solid gel may undergo a small amount of expansion and contraction during typical freeze/thaw cycles. The insulation material, by virtue of its closed-cell nature, is resilient, i.e., it compresses and expands under the corresponding expansion and contraction of the gel as it undergoes its freeze/thaw cycle. The ability of the insulation to accommodate any change in dimension of the gel substantially eliminates the possibility that the holder will rupture during any expansion of the gel. Additionally, the space 52 between the lower wall 22 and the support 16 provides a region within which the gel may expand.

Figure 3:
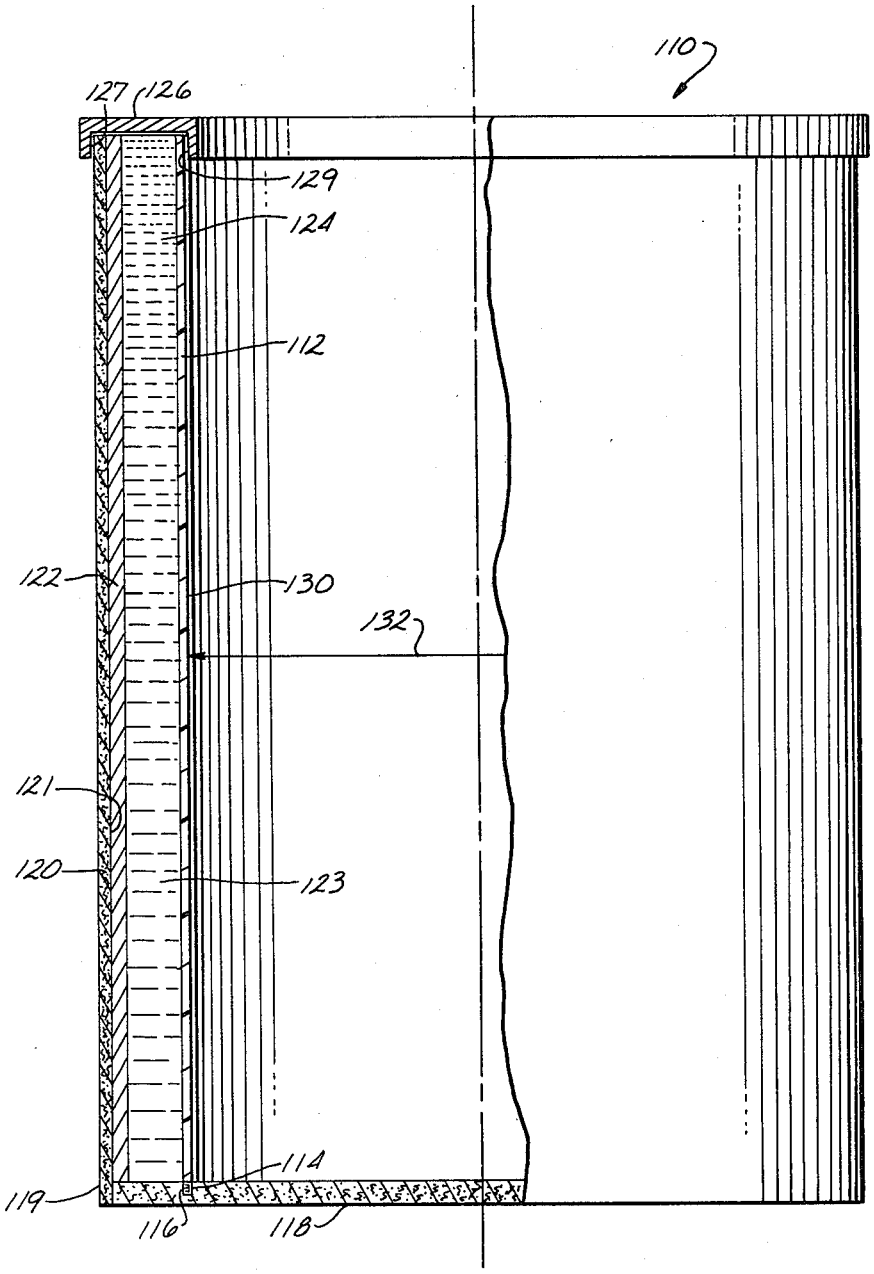
FIG. 3 is a view in elevation and partly in cross section of a second embodiment of a holder embodying the principles of the invention.

Referring now to FIG. 3, there is shown an alternate embodiment of the herein-described invention. The holder 110 has a cylindrical inner wall 112 that is formed preferably of a fracture-resistant plastic such as polyvinyl chloride.

Figure 4:
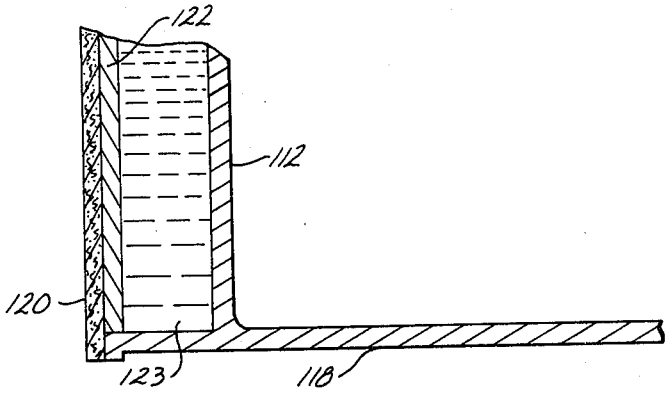
FIG. 4 is a partial view in cross section of an alternate embodiment of the receptacle wall and base of the holder of FIG. 3.

The lower extremity of the wall 112 seats in a corresponding annular groove 116 formed in a holder base or support 118. The wall 112 may be rigidly maintained in the base groove 116 by means of any one of a number of conventional adhesives. The base 118 may be formed of polyvinyl chloride. Preferably, as shown in FIG. 4, the wall 112 and base 118 are formed in a single unitary water-tight enclosure formed from polyvinyl chloride.

A cylindrical encasement 120 forms the outer perimeter of the holder 110. The encasement 120 is secured at its lower extremity 122 to the base 118. The securement may be provided by any one of a number of conventional techniques, such as the use of adhesives and the like. Adjacent the encasement inner wall surface 121 is disposed a sheet of insulation 122. The insulation 122 is preferably formed of closed-cell, chain-linked styrene, and has a thickness across its lateral faces of about ⅛ inch.

An annular cavity 123 formed between the insulation 122 and the inner wall 112 is filled with a solid refrigerant gel 124. The gel 124 comprises the same ingredients previously discussed for the embodiment shown in FIG. 1.

An annular cap 126 having a U-shaped cross section is sized so that the distance between its interior side walls 127 and 129 is approximately equal to the distance between the encasement outer wall surface 129 and inner wall surface 130. The cap 126 fits over the upper annular extremity of the holder 110 and is secured thereto by any one of a number of conventional techniques such as the use of adhesives. Other techniques such as crimping may also be used in securing the cap to the holder. In securing the cap to the holder, the annular cavity 123 is completely closed and isolated from the surrounding environment.

Although the inner wall diameter 132 may be any arbitrary size, preferably the diameter 132 is selected slightly larger than conventional cylindrical wine bottles. Thus, in the instance where it is desired to maintain a bottle of wine in a chilled state during consumption, the bottle may be placed in the holder subsequent to exposing the holder to the temperatures desired for the beverage. Advantageously, water may be placed in the holder to increase the thermal conductivity between the wall 112 and a bottle placed in the holder. Thus, the chilling effect of the refrigerant gel is transferred to the bottle through the water.

While the basic principle of this invention has been herein illustrated along with two embodiments, it will be appreciated by those skilled in the art that variations in the disclosed arrangement, both as to its details and as to the organization of such details, may be made without departing from the spirit and scope thereof. Accordingly, it is intended that the foregoing disclosure and the showings made in the drawings will be considered only as illustrative of the principles of the invention and not construed in a limiting sense.

What is claimed is:

1. An insulated beverage cooling container comprising:

an inner receptacle for receiving a beverage, the receptacle having a closed end and an open end and a wall disposed between said open and closed ends;

an outer encasement encasing the inner receptacle, said encasement having an upper end joined to the inner receptacle adjacent the open end thereof and a rigid exterior wall surrounding the wall of the inner receptacle and forming thereby a closed cavity between the inner receptacle and the encasement;

a layer of cellular, compressible heat-insulating material within the cavity secured to the inside surface of the exterior wall of the encasement; and a solid gel refrigerant disposed within the cavity between the compressible insulation layer and the wall of the receptacle, said gel being in direct contact with the compressible insulation layer and having a freezing temperature of about 30° F., the compressible insulation layer being capable of compressing and expanding under corresponding expansion and contraction of the gel as it undergoes a freeze/thaw cycle.

2. The container of claim 1 wherein the insulating material comprises a closed-cell styrene.

3. The container of claim 2 wherein the refrigerant gel consists of about 15% by weight of cornstarch, borax in the amount of about 2% by weight of cornstarch, about 0.01% by weight of non-toxic preservative and about 85% by weight of water.

4. The container of claim 3 wherein the preservative comprises potassium sorbate.

5. The container of claim 4 wherein the receptacle comprises polyvinyl chloride.

6. The container of claim 4 wherein the encasement comprises heat-insulating cardboard.

7. The container of claim 6 wherein the lower end of said encasement forms the closed end of the receptacle, said lower end of the encasement comprising particle board.

8. The container of claim 6 wherein the lower end of said encasement forms the closed end of the receptacle, said lower end of the encasement comprising polyvinyl chloride.

9. The container of claim 1 wherein the refrigerant gel consists essentially of about 15% starch, less than about 1% borax, and less than about 1% of a non-toxic preservative, by weight, with the balance being water.

* * * * *